United States Patent [19]

Bender

[11] Patent Number: 4,483,105

[45] Date of Patent: Nov. 20, 1984

[54] DEVICE TO HOLD WORKPIECES FOR THE HONING OF THEIR AXIAL CENTER BORE

[75] Inventor: Albert Bender, Ostfildern, Fed. Rep. of Germany

[73] Assignee: Maschinenfabrik Gehring, Gesellschaft mit beschrankter Haftung & Co. Kommanditgesellschaft, Fed. Rep. of Germany

[21] Appl. No.: 474,472

[22] Filed: Mar. 11, 1983

[51] Int. Cl.[3] ..... B24B 19/00

[52] U.S. Cl. ..... 51/227 R; 279/1 G

[58] Field of Search ..... 51/227, 216 ND, 216 R; 279/1 G

[56] References Cited

U.S. PATENT DOCUMENTS

| | | | |
|---|---|---|---|
| 1,561,843 | 11/1925 | Garrison | 279/1 G |
| 1,725,342 | 8/1929 | Copland | 279/1 G |
| 2,450,970 | 10/1948 | Lanze | 279/1 G |
| 2,747,882 | 5/1956 | Garrison | 279/1 G |

FOREIGN PATENT DOCUMENTS

| | | | |
|---|---|---|---|
| 20536 | of 1907 | United Kingdom | 51/227 R |

*Primary Examiner*—Harold D. Whitehead

*Attorney, Agent, or Firm*—Schwartz, Jeffery, Schwaab, Mack, Blumenthal & Koch

[57] ABSTRACT

A device to hold workpieces, in particular gears, to hone an existing axial center bore, consisting of a workpiece support member, which may be loaded and unloaded from one side. Levers supported pivotably in grooves formed in the workpiece support member are provided with tooth-like ends which engage tooth gaps of the workpiece in an approximately diametrically opposed manner. The levers are resiliently biased to rest in their engaged position in the direction of rotation of machining against stop surfaces of the grooves, with the levers being pivoted in the opposite direction during unloading to disengage the lever ends from the workpiece.

10 Claims, 3 Drawing Figures

Fig. 1
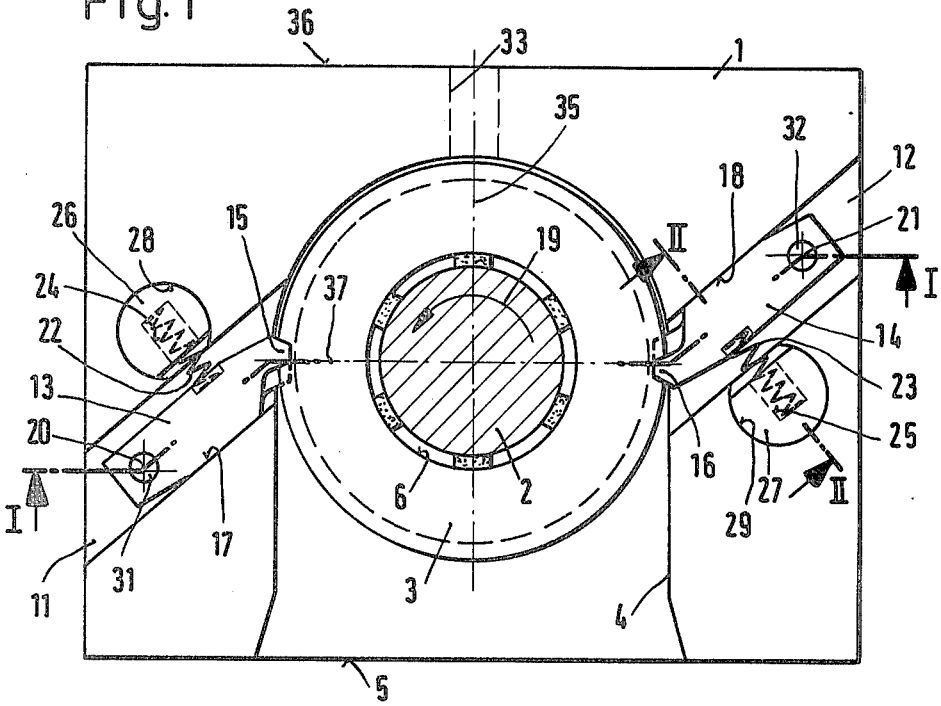
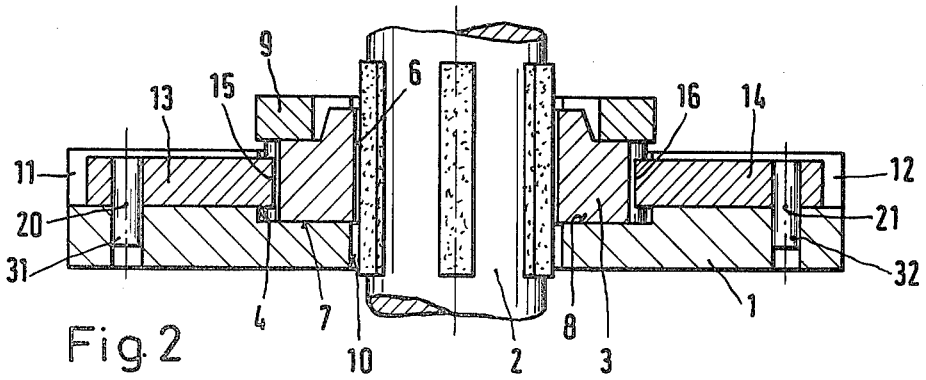
Fig. 2
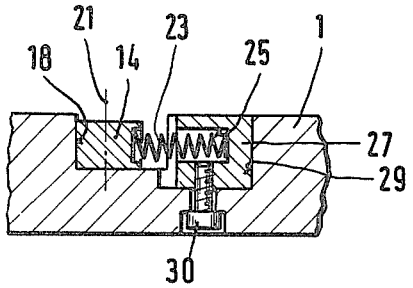
Fig. 3

DEVICE TO HOLD WORKPIECES FOR THE HONING OF THEIR AXIAL CENTER BORE

FIELD AND BACKGROUND OF THE INVENTION

The invention relates to devices for holding workpieces, for example, gears, to permit the honing of an axial center bore in the workpiece.

In a known device of this type, the workpiece is held during honing by a work holder plate floatingly supported transversely to the tool axis, with a plurality of work holder plates being arranged in the axial direction of the honing tool one above the other. To hold workpieces, the work holder plates are provided with a recess adapted to the size and configuration of the workpieces, the recess being open toward the front side of the work holder plate. From this front side, the workpiece may be inserted in the recess until the bore to be machined is approximately in the axis of the honing tool. The workpiece rests with an axial front surface against a shoulder provided within the recess, and is clamped in this position by two clamping chucks arranged opposite to each other under spring pressure and acting on the front side. After machining, the chucks are moved against the force of the spring to release the workpiece, whereby the workpiece is set free and may be taken from the fixture. For secure, twist free transfer of the machining torque a very high clamping force is required, which could lead to elastic deformations of the workpiece. Machining accuracy is therefore considerably reduced.

In another known device, a holding pin is provided which engages a gap of the gear teeth. Since, however, as the result of the unilateral torque support, a residual center force is created which urges the workpiece out of its set position. This device similarly is not suitable for the attainment of high working accuracies. Furthermore, in devices of this type, the workpieces tend to tilt under the effect of the axial machining forces. These two conditions significantly affect the machining accuracy, with consequent detrimental affect on the quality of the workpiece.

SUMMARY OF THE INVENTION

The principal object of the invention is to provide a device to hold workpieces, in particular gears, so that the workpieces while held without deformation, will transfer the machining torque generated in the process of honing to the workpiece support free of center forces. The workpiece holder may be loaded and unloaded from the front side.

The workpieces are supported against twisting and cannot be forced into an oblique position. By means of the configuration, arrangement and pivoting of the claw shaped levers to hold the workpiece, the unimpaired loading and unloading of the fixture is possible from one side of the holder.

For the accurate axial immobilization of the workpiece, a hold-down device which precludes axial play, known in itself, can additionally be provided according to DE-OS No. 30 07 267, whereby harmful tilting movements are prevented.

Further characteristics of the invention will become apparent from the following description and drawings.

BRIEF DESCRIPTION OF THE APPLICATION DRAWING

FIG. 1 shows a top plan view of a device according to the invention;

FIG. 2 is a section on the line I—I in FIG. 1, and

FIG. 3 is a partial section on the line II—II in FIG. 1.

DETAILED DESCRIPTION OF THE PREFERRED EMBODIMENT

The device to hold a workpiece comprises an approximately rectangular, plate-like workpiece support 1, which is supported for floating in a manner well known in the art and accordingly not illustrated. Preferably, several workpiece supports 1 are arranged for a common honing process, in the axial direction of the honing tool 2, above each other.

To receive the workpiece 3, for example, a gear, a recess 4, slightly larger in diameter than the gear 3, is machined axially into the workpiece carrier 1. The recess 4 is open at the front side 5 of the workpiece support 1 so that the gear may be inserted into the recess 4 from the front of the support. In the inserted position the bore 6 of the gear 3 lies with its axis approximately concentric with that of the honing tool. The bottom surface 7 of the gear 3 rests on the bottom surface 8 of the recess 4. By means of a hold-down device 9, which is per se well known in the art, the gear is held in the inserted position axially without play. To allow for the passage of the honing tool 2, the workpiece support 1 has a continuous bore 10 concentric with the axis of the gear and slightly larger than the bore of the gear.

To transmit the machining torque to the workpiece support 1, which is held fixedly against rotation (in a manner not shown), two claw like levers 13, 14 are located according to the invention diametrically opposed to each other, with each engaging one tooth gap of the gear 3, by means of their tooth shaped ends 15, 16.

The levers 13 and 14 are arranged pivotably around pivoting axles 20 and 21, respectively, and the levers, when the ends 15 and 16 engage the gaps between gear teeth, abut shoulder surfaces 17 and 18 of the workpiece support 1. The levers are therefore immobilized in the direction of the machining rotation (arrow 19). When pivoted in the opposite direction, the levers 13 and 14 pivot about axles 20 and 21 far enough against the bias of the prestressed springs 22 and 23 so that the tooth shaped ends 15 and 16 are disengaged from the gear 3.

By virtue of the levers 13 and 14, the workpiece 1 may be loaded and unloaded from the front side 5 of the support, since during the insertion of a gear 3 into the recess 4 the lever 13 will be pivoted away from the gear 3, and during the withdrawal of the gear 3 the lever 14 is pivoted away from the gear 3. Thus, the gear teeth roll over the ends 15 and 16 of the levers 13 and 14, respectively. In the case where workpiece supports are arranged above each other, in order to make possible the simple removal of the gear 3, a continuous passage 33 or the like is provided on the side 36 opposite to the opening of the recess, whereby, for example by means of a rod, the gear may be pushed out of the device according to the invention.

The springs 22 and 23 apply force to the levers 13 and 14 in the direction of rotation (arrow 19) of the honing tool, and are preferably compression springs, supported against the bottom of guide bores 24 and 25, respectively. The guide bores are formed articulated pieces 26 and 27, mounted rotatably in bores 28 and 29 of the workpiece support 1. As shown in FIG. 3, each articulated piece after rotatable adjustment may be clamped tight by a screw 30.

Advantageously, the levers 13 and 14 are arranged in grooves 11 and 12, respectively, formed in the support, with each of said grooves being formed so that they are at an angle of approximately 45° to the longitudinal center line 35, with the grooves also intersecting the diametric line 37 determined by the points of engagement of the levers 13 and 14 at an approximate angle of 45°. The lateral surfaces of the grooves 11 and 12 facing the direction of rotation of the machining (arrow 19) form the stop surfaces 17 and 18 so that the levers in their engaged position are at an approximate angle of 45° to the recess 4. The width of the grooves 11 and 12 is such that the path of the pivoting of the levers 13 and 14 about pins 31 and 32 is limited to the extent necessary for the release of the workpiece 3. The depth of the grooves 11 and 12 is such that the levers 13 and 14 are received completely in the corresponding groove. (FIG.2).

Due to the levers 13 and 14 being arranged obliquely in the engaged position, a long path may be achieved radially with respect to the gear, with the gear 3 being released by a lever after a short pivoting path.

Advantageously, the levers 13 and 14 are identical, with their pivoting axles 20 and 21 located on an imaginary common circle the center of which is on the axis of the honing tool 2, whereby in operation an automatic centering of the gear 3 is obtained with respect to the axis of the honing tool. In the case of gears with an even number of teeth the pivoting axles 20 and 21 face each other in an exactly diametrical manner, while in the case of workpieces with an odd number of teeth, they are facing each other offset by a one-half pitch angle.

In the matching of helical gears the levers 13 and 14 are arranged so that the axial forces generated by the torque support are directed against the bottom surface 8 of the recess 4, with the bottom 7 of the workpiece 3 being pressed against the bottom surface 8 of the support 1. In this manner the hold-down device 9, which prevents axial play of the workpiece, is relieved of axial stress, whereby a higher machining accuracy may be obtained.

I claim:

1. A device to hold peripherally toothed workpieces for the honing of an axial center bore therein, comprising:

(a) a workpiece support member having a center bore, a recess in one side thereof and continuing into the center of the support member for loading and unloading the workpiece, and a pair of grooves substantially diametrically opposed to each other and extending in an oblique direction relative to a horizontal center line through said recess and the axis of said support member, the inner ends of said grooves communicating with said bore, (b) levers pivotably mounted in each of said grooves, said levers being of a width smaller than the width of said grooves and having end portions adapted to engage gaps between teeth of the workpiece, said levers engaging the edges of said grooves during the machining operation whereby said ends preclude rotation of the workpiece during the honing operation, and (c) means for resiliently biasing said levers in the direction of rotation of machining to said position of engagement, movement of the workpiece outwardly through said opening during unloading biasing at least one of said levers so that the end of said one lever is rotated out of the path of said workpiece thereby permitting the same to be unloaded from the support.

2. The device according to claim 1, characterized in that the levers are resiliently biased in the direction of rotation of machining by means of springs.

3. The device according to claim 2, characterized in that each of said springs is supported by an articulated piece, said articulated pieces being arranged on the workpiece support member for rotatable adjustment, and means for maintaining said pieces in said adjusted position.

4. The device according to claim 1, characterized in that the levers in their engaged position are arranged obliquely, preferably at an angle of 45° to said center line, and that said recess is in the front of said support member.

5. The device according to claim 1, characterized in that the engaged edges of said grooves facing the direction of machining are in the form of stop surfaces.

6. The device according to claim 3, characterized in that the articulated pieces are arranged rotatably in bores formed in the workpiece support member, and the springs are located in guide bores in the articulated pieces.

7. The device according to claim 5 characterized in that the width of the grooves when compared with the smaller width of said levers is such that a sufficiently great pivoting path is provided for a lever to release the workpiece.

8. The device according to claim 1, characterized in that the levers are identical and that their pivoting axles are located on a common circle, the center of which is located on the axis of a honing tool.

9. The device according to claim 8, characterized in that in the case of workpieces with an even number of teeth the pivoting axles are exactly diametrical to each other.

10. The device according to claim 1, characterized in that in the case of helical gears the lever ends engage the teeth so that the axial forces generated by the torque support are directed against the bottom surface of the opening in the support member.

* * * * *